United States Patent [19]

Yoshinaga et al.

[11] 4,350,137

[45] Sep. 21, 1982

[54] IGNITION SYSTEM FOR INTERNAL COMBUSTION ENGINES

[75] Inventors: Toru Yoshinaga, Okazaki; Toshihiko Igashira, Toyokawa; Kouichi Mori, Okazaki; Hisasi Kawai, Toyohashi; Seiji Morino, Aichi, all of Japan

[73] Assignee: Nippon Soken, Inc., Nishio, Japan

[21] Appl. No.: 257,139

[22] Filed: Apr. 24, 1981

[30] Foreign Application Priority Data

May 29, 1980 [JP] Japan ..... 55-72273
May 29, 1980 [JP] Japan ..... 55-72274

[51] Int. Cl.[3] ..... F02P 7/00

[52] U.S. Cl. ..... 123/617; 123/146.5 A; 123/425; 123/651

[58] Field of Search ..... 123/146.5 A, 425, 594, 123/612, 613, 617, 627, 643, 644, 651, 656

[56] References Cited

U.S. PATENT DOCUMENTS

| | | | |
|---|---|---|---|
| 3,612,011 | 10/1971 | Monpetit | 123/643 X |
| 4,019,486 | 4/1977 | Siegle | 123/146.5 A X |
| 4,231,348 | 11/1980 | Schiele et al. | 123/440 X |
| 4,267,803 | 5/1981 | Formato | 123/146.5 A |
| 4,304,203 | 12/1981 | Garcea et al. | 123/425 X |

*Primary Examiner*—Tony M. Argenbright
*Attorney, Agent, or Firm*—Cushman, Darby & Cushman

[57] ABSTRACT

An ignition system for a spark-ignition engine includes an ignition coil for applying a high voltage to each spark plug, a switch device connected in series with the secondary of the ignition coil for preventing in response to its conduction the supply of the high voltage to the spark plug, and a control circuit for turning on the switch device at a predetermined time after the generation of the high voltage, whereby the discharging at the spark plug is prevented under the combustion condition.

4 Claims, 6 Drawing Figures

IGNITION SYSTEM FOR INTERNAL COMBUSTION ENGINES

BACKGROUND OF THE INVENTION

1. Field of the Invention

The present invention relates to ignition systems for spark ignition type engines and more particularly to an improved ignition system which is capable of reducing wear of spark plug electrodes.

2. Description of the Prior Art

Recently, the spark plugs used in automobiles have been required to produce strong spark discharges due to the introduction of exhaust emission controls and use of thiner air-fuel mixtures and hence wear of the plugs has becomes increasingly severe. Moreover, the Official prescription of plug maintenance has been predicted in certain countries and there has been an increasing demand for an ignition system designed to reduce wear of spark plug electrodes.

In known ignition systems of the type employing a high voltage generator, the discharge time of the spark plug amounts to about 2 ms and this discharge time is practically held constant even at higher engine speeds. In such a case, the spark plug maintains the discharge even after the top dead center (TDC) so that if the ignition occurs before the TDC, a combustion is started at around the TDC and consequently the wasteful discharge is continued even after the combustion has already started. When a combustion is taking place in a combustion chamber, both the temperature and pressure in the combustion chamber become very high and consequently the discharging at the spark plug in such a condition has the disadvantage of greatly promoting wear of the plug electrodes.

To overcome this disadvantage, a method has been proposed in U.S. Pat. No. 3,896,776 in which the primary winding of the ignition coil is again energized at a specified time instant so as to interrupt the undesired ignition spark. A disadvantage of this method is that since the ignition spark is continued until the specified time instant, if the ignition is accomplished by that time instant, the plug wear reducing effect will be deteriorated. Further, the application of this method to a conventional ignition system has the disadvantages of requiring a considerable modification of the system and excessively increasing the energization time of the primary winding resulting in overheating the ignition coil.

SUMMARY OF THE INVENTION

It is an object of the present invention to provide an improved ignition system which overcomes the problem of plug electrode wear while overcoming the foregoing deficiencies in the prior art.

In accordance with the present invention there is provided an ignition system comprising an ignition coil for applying a high voltage (spark voltage) to each spark plug, a switching device connected to the ignition coil, for preventing in response to its conduction the application to the spark plug of the high voltage produced in the ignition coil, and a control unit for turning on the switching device at a predetermined time after the generation of the high voltage. This construction has the effect of very greatly reducing wear of the spark plug electrodes, since the discharging at the spark plugs is minimized under such conditions where the plug electrodes wear rapidly due to a high temperature and pressure in the combustion chamber. Also, by simply adding to the conventional ignition system a part of the electric circuitry forming the principal part of the present invention, it is possible to provide the system with a function for reducing the wear of the spark plug electrodes.

Also, even in case of an internal combustion engine practically in use, by simply adding the devices forming the principal parts of the invention, it is possible to use its conventional ignition system as such. Moreover, there is no danger of increasing the energizing time of the primary winding, thereby avoiding overheating of the ignition coil.

DESCRIPTION OF THE PREFERRED EMBODIMENTS

Figure 1:
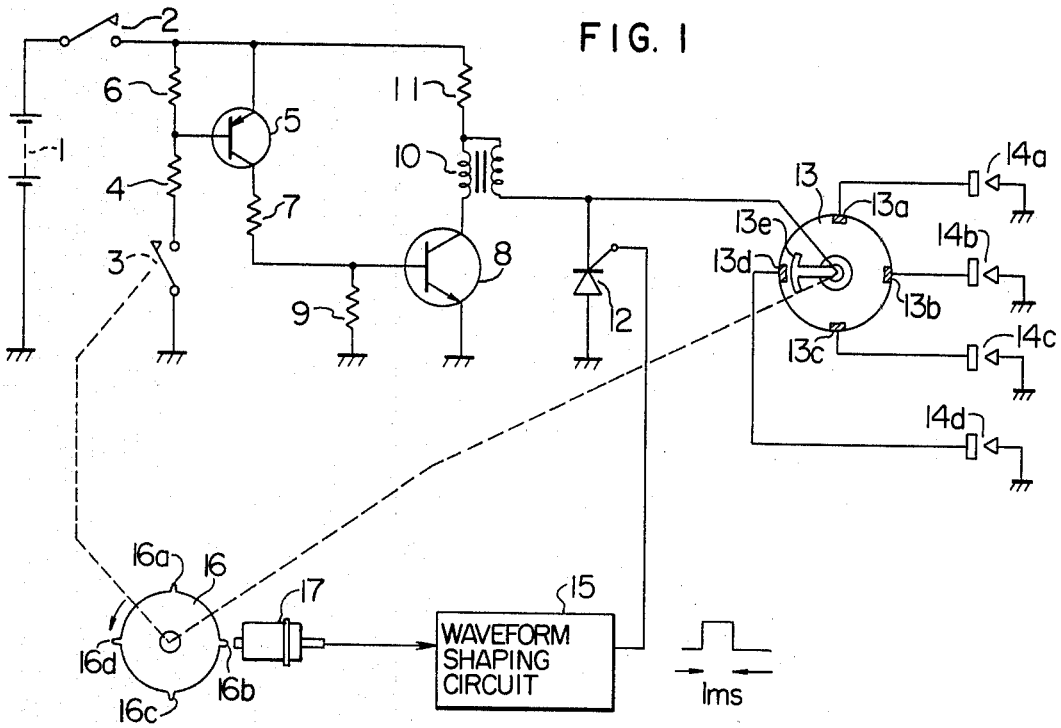
FIG. 1 is a circuit diagram of an ignition system according to an embodiment of the present invention.

The present invention will now be described in detail with reference to the illustrated embodiments. Referring to FIG. 1, numeral 1 designates a battery whose negative terminal is grounded, and 2 a key switch having its one end connected to the positive terminal of the battery 1. Numeral 3 designates a breaker contact incorporated in a distributor unit and having its one end grounded and its other end connected to one end of a resistor 4 whose other end is connected to the base of a PNP transistor 5. The emitter of the transistor 5 is connected to the other end of the key switch 2. A resistor 6 is connected across the emitter and the base of the transistor 5. The collector of the transistor 5 is connected to one end of a resistor 7 whose other end is connected to the base of an NPN power transistor 8. The emitter of the power transistor 8 is grounded. A resistor 9 is connected between the base and emitter of the power transistor 8. The collector of the power transistor 8 is connected to one end of the primary winding of an ignition coil 10.

The primary winding of the ignition coil 10 has its other end connected, along with one end of the secondary winding, to one end of a resistor 11. The other end of the resistor 11 is connected to the other end of the key switch 2. The secondary winding of the ignition coil 10 has its other end connected to the cathode of a thyristor 12 and to a rotary electrode 13*e* of a high voltage distributor 13 of the distributor unit. The anode of the thyristor 12 is grounded and its gate is connected to the output of a waveform shaping circuit 15. The resistance values of the resistors 4, 6, 7, 9 and 11 are for example selected 24, 100, 12, 33 and 1.4 ohms, respectively.

Numeral 16 designates a disk of magnetic material contained in the distributor unit. Since the present embodiment is incorporated in a four-cylinder internal combustion engine, the disk 16 is formed with four projections 16*a* and 16*d* arranged at equal spaces on its periphery and respectively corresponding to the top dead centers (TDC) of the respective cylinders. These projections are detected by a sensor 17. The sensor 17 is of a magnet pick-up type which is generally put on the market. The output of the sensor 17 is connected to the shaping circuit 15. The shaping circuit 15 comprises an amplifier for amplifying the signal from the sensor 17, a comparator for clamping the amplifier output at a predetermined threshold voltage to convert it to a pulse and a monostable multivibrator for converting the comparator output into a predetermined pulse width. This predetermined pulse width is preset to about 1 ms.

The high voltage distributor 13 of the distributor unit includes four fixed electrodes including a fixed electrode 13*a* connected to a spark plug 14*a* (No. 1 cylinder), a fixed electrode 13*b* connected to a spark plug 14*b* (No. 3 cylinder), a fixed electrode 13*c* connected to a spark plug 14*c* (No. 4 cylinder) and a fixed electrode 13*d* connected to a spark plug 14*d* (No. 2 cylinder).

Figure 2:
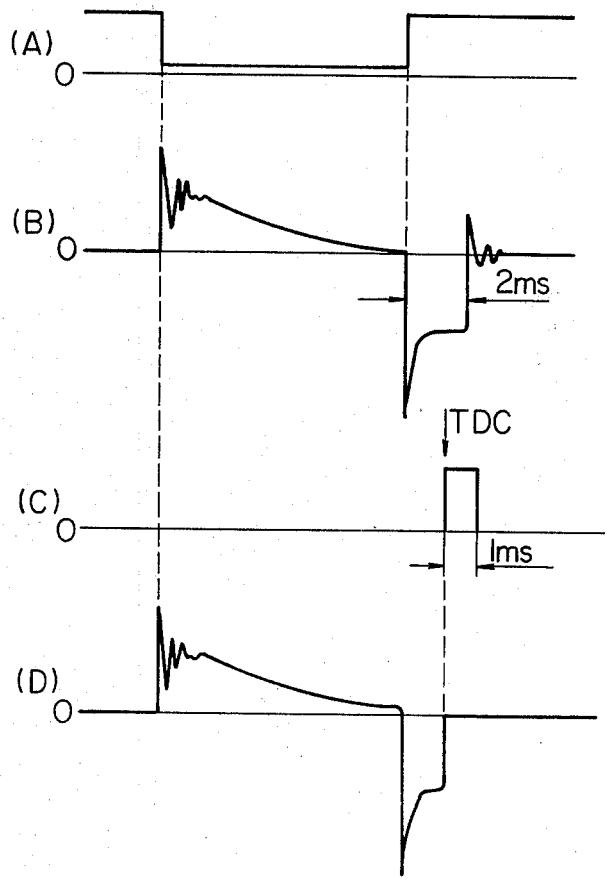
FIG. 2 shows various waveforms for explaining the operation of the ignition system shown in FIG. 1.

With the construction described above, the operation of this embodiment is as follows. The key switch 2 is closed first so that the distributor breaker contact 3 is closed and opened in response to the rotation of the engine. As a result, when the breaker contact 3 is closed, the transistor 5 is turned on and a current flows through the resistor 7 and the base-emitter path of the power transistor 8. Consequently, the power transistor 8 is turned on and a current flows through its load or the primary winding of the ignition coil 10. Then, as the breaker contact 3 is opened, the transistor 5 is turned off, so that the power transistor 8 is turned off, and the primary current of the ignition coil 10 is interrupted. At this instant, a high voltage is produced in the secondary winding and a spark is produced at the proper spark plug. FIG. 2 shows voltage waveforms generated at this time. In the Figure, (A) shows the base voltage waveform of the transistor 5, and (B) shows the high voltage produced in the secondary winding of the ignition coil 10 when the thyristor 12 is not in operation.

In the condition shown in FIG. 1, the rotary electrode 13*e* is close to the fixed electrode 13*d* and thus a discharge takes place at the spark plug 14*d*.

Usually, the discharging at the spark plug starts at about 10° before the TDC, and after the discharging has started, it is maintained until the magnetic energy stored in the ignition coil 10 is exhausted. The duration time of the discharge is less than about 2 ms. After the initiation of discharging at the spark plug, the combustion of the gasoline takes place just after the TDC in practically all the cases, so that after the TDC the discharging at the spark plug only results in wear of the spark plug and it has no effect on the combustion.

In accordance with this embodiment, the sensor 17 produces an output signal in association with the disk 16 rotated in synchronism with the operation of the breaker contact 3 and the signal is converted through the shaping circuit 15 into a pulse having the waveform shown in (C) of FIG. 2. This pulse is applied to the gate of the thyristor 12 so that the thyristor 12 is turned on. When this occurs, the current flowing through the spark plug via the high voltage distributor 13 of the distributor unit now flows through the cathode-anode path of the thyristor 12 and the spark plug stops discharging. In this case, the secondary high voltage waveform becomes as shown in (D) of FIG. 2. The thyristor 12 is turned off when the magnetic energy in the ignition coil 10 has been discharged thus generating no voltage in the secondary winding.

Although, in the embodiment described above, only the single thyristor 12 is shown, actually its internal structure comprises a plurality of thyristors connected in series to withstand the secondary high voltage which is usually 30 KV. Thus, it will be apparent to those skilled in the art to use a series combination of 10 commercially available thyristors each capable of withstanding the voltage of 3 KV.

In the above-described embodiment, the ignition system includes the breaker contact 3. However, it is apparent that the same effect can be obtained with a contactless fully-transistorized ignition system which is now in use.

Further, while, in the embodiment, the spark discharge is stopped at the TDC, it is of course possible to stop the spark discharge at any other point in the range between 5° before and 10° after the TDC. It should be apparent that the time of stopping the spark discharge can be selected as desired by suitably selecting the relative positions between the sensor 17 and the projections 16*a* to 16*d* on the disk 16.

It should also be apparent from the objective of this invention that while, in the above embodiment, the spark is terminated by connecting the secondary winding of the ignition coil 10 to the ground via the thyristor 12, it is possible to use a relay in place of the thyristor.

Figure 3:
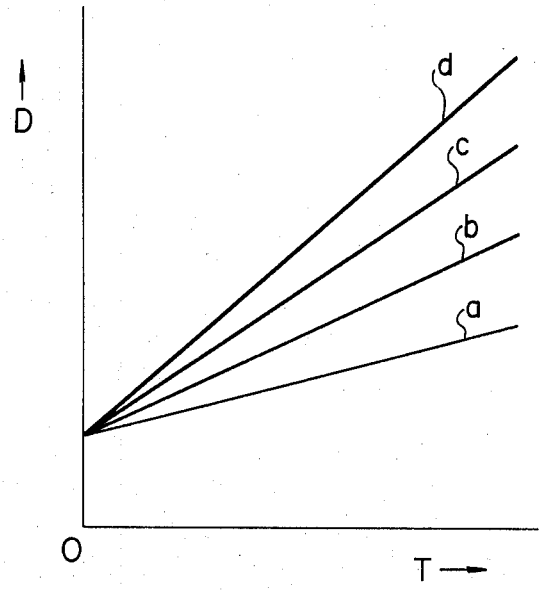
FIGS. 3 and 4 are graphs respectively showing the rate of wear of plug electrodes using the combustion pressure and temperature as parameters.

FIG. 3 shows the rates of spark plug electrode were obtained when the combustion pressure was varied. In the Figure, the abscissa represents the time T and the ordinate represents the plug gap D. The curve a corresponds to 5 atmospheres, b to 10 atmospheres, c to 15 atmospheres and d to 20 atmospheres, showing that the rate of electrode wear increases with increase in the pressure.

Figure 4:
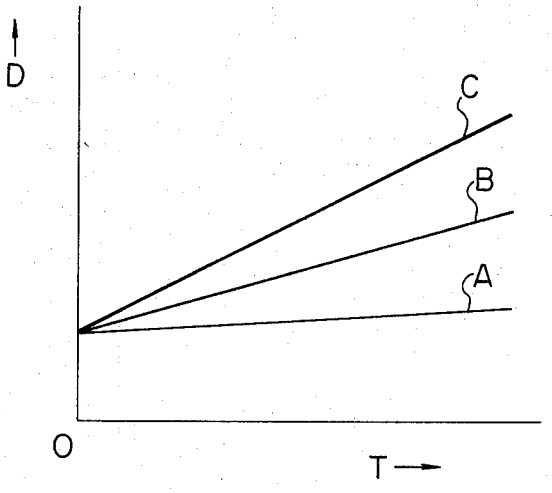

FIG. 4 shows the rates of plug electrode wear for different atmospheric temperatures with the pressure held constant. In the Figure, the abscissa represents the time T and the ordinate represents the plug gap D. The curve A corresponds to the room temperature, B to 400° C. and C to 800° C., showing that the rate of electrode wear increases with increase in the temperature. Thus, it will be seen that the rate of plug electrode wear increases with increase in the pressure and temperature.

In accordance with the present embodiment, by virtue of the fact that the discharge at the spark plug is stopped by grounding at a predetermined crank angle the high voltage generated by the high voltage generator for application to the spark plug, there is a great advantage that a spark discharge is prevented in conditions where the plug electrodes wear rapidly under the high temperature and pressure during the combustion of the air-fuel mixture, and the wear of the spark plug electrodes is reduced considerably.

Further, in accordance with the present embodiment, since what is needed is to add the disk 16 and the sensor 17 to the distributor unit and connect an electric circuit between the secondary winding of the ignition coil and the spark plugs so as to ground the spark producing high voltage in case of need, there is an advantage that the first-mentioned advantage can be obtained without any modification of the conventional ignition system and thus the present embodiment can be easily applied to the engines practically in use.

Another advantage is that since there is no need to modify the conventional ignition system, there is no danger of disadvantages due to system modifications (e.g., overheating of the ignition coil).

Figure 5:
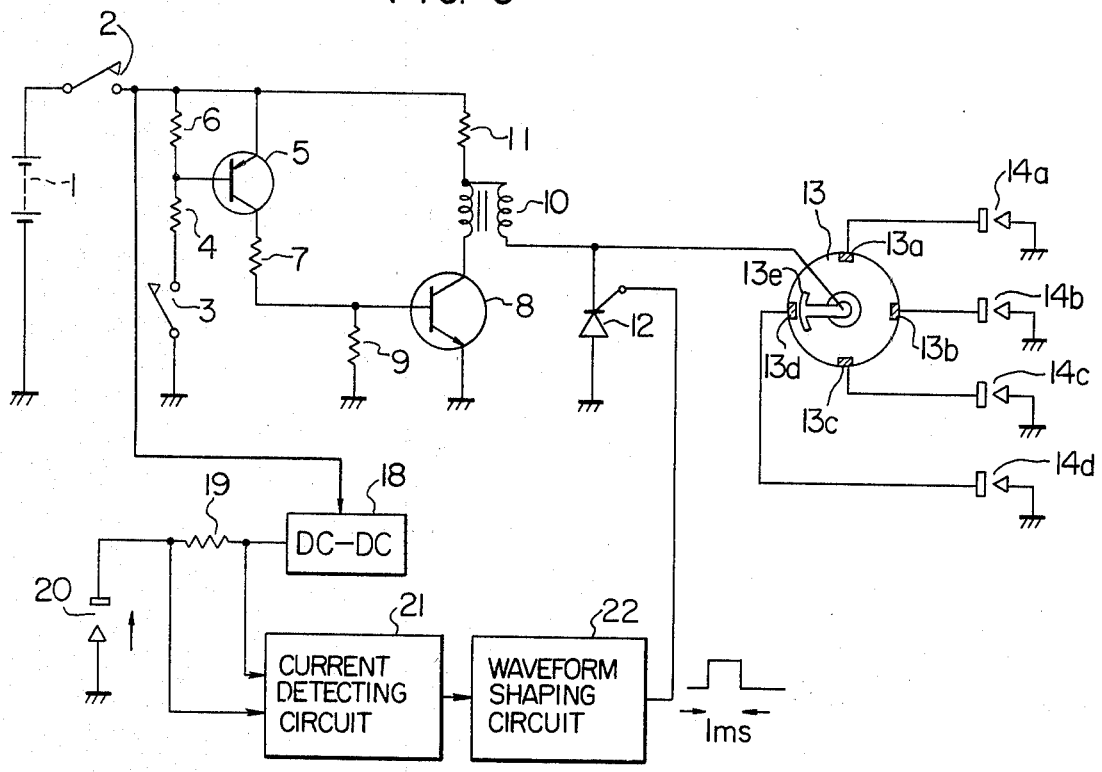
FIG. 5 is a circuit diagram of an ignition system according to another embodiment of the present invention.

Another embodiment of the present invention will now be described with reference to FIG. 5. In the Figure, the same reference numerals as used in FIG. 1 indicate the same component parts and the explanation as to such parts is omitted.

Number 18 designates a DC-DC converter for generating a DC voltage of −100 V from the battery voltage (12 V). The converter 18 is connected to an ion current detecting plug 20 via a resistor 19. The resistor 19 forms an ion current detecting resistor. Numeral 21 designates a current detecting circuit comprising a voltage divider circuit for dividing the voltage generated across the resistor 19, a differential amplifier for differentially amplifying the output of the divider circuit and a comparator for comparing the output of the amplifier with a preset value. This circuit generates a high level signal when the ion current detected by the resistor 19 exceeds a preset value. Numeral 22 designates a waveform shaping circuit comprising a monostable multivibrator which generates a pulse signal having a width of about 1 ms when its input signal changes from the low level to the high level.

Figure 6:
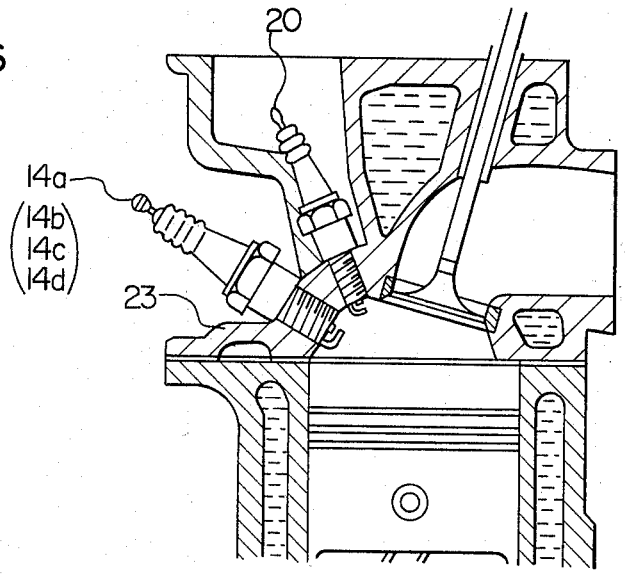
FIG. 6 is a partial longitudinal sectional view of an engine showing a structure by which an ion current detecting plug used in the ignition system of FIG. 5 is mounted to the engine.

FIG. 6 shows by way of example the mounting position of the spark plug 14*a*, (14*b*, 14*c*, 14*d*) and the ion current detecting plug 20 to each engine cylinder. It is desirable that the ion current detecting plug 20 is mounted to each of the cylinders in such a manner that it is mounted in a cylinder head 23 at a position as close to the spark plug as possible so as to detect the formation of a flame in the combustion chamber at the earliest possible time after the ignition at the spark plug. It should be apparent that each of the spark plugs 14*a* to 14*d* may be of the unitary construction incorporating the ion current detecting plug 20 integrally therewith.

With the construction described above, the operation of this embodiment will now be described. When the thyristor 12 is not in operation, the operation is the same as the embodiment of FIG. 1 and the secondary high voltage of the ignition coil 10 has a waveform as shown in (B) of FIG. 2.

When the mixture is ignited before the TDC by the high voltage generated in the ignition coil 10, the combustion of the mixture takes place at around the TDC. Since the DC voltage of about −100 V is being applied from the DC-DC converter 18 to the ion current detecting plug 20 via the resistor 19, when the combustion is started and a flame reaches the gap of the ion current detecting plug 20, a current flows from the ground side to the DC-DC converter 18 via the plug 20 and the resistors 19. This current produces the corresponding voltage across the resistor 19. This generated voltage is differentially amplified by the current detecting circuit 21. Since the voltage of about −100 V is produced across the resistor 19, the voltage is decreased through resistance division by the resistive divider circuit so as to protect the input of the differential amplifier. The amplified voltage corresponding to the ion current is compared with a preset voltage in the comparator so that a high level signal is generated when the amplified voltage is higher than the preset voltage and a low level signal is generated when the amplified voltage is lower than the preset voltage. The comparator output is delivered as the output of the current detecting circuit 21. The shaping circuit 22 comprising a monostable multivibrator generates a pulse of 1 ms when the signal from the current detecting circuit 21 changes from the low level to the high level. When this occurs, the thyristor 12 is turned on. This pulse waveform is the same as that shown in (C) of FIG. 2. As a result, the current flowing through the spark plug from the high voltage distributor 13 of the distributor unit is now interrupted and the discharging at the spark plug is stopped. In this case, the waveform of the secondary voltage is the same as shown in (D) of FIG. 2. As mentioned previously, the thyristor 12 is turned off after the magnetic energy of the ignition coil 12 has been exhausted thus generating no voltage in the secondary winding.

While, in the second embodiment, the discharging at the spark plug is stopped by grounding the secondary winding of the ingition coil 10 via the thyristor 12, it is possible to use a relay in place of the thyristor. It should be apparent that in the second embodiment as well as the embodiment of FIG. 1, it is possible to stop the discharging at the spark plug by establishing a short-circuit between the terminals of the primary winding and thereby interrupting the high voltage generated in the secondary winding.

It will thus be seen from the foregoing description that while the ignition of the mixture in the combustion chamber by the spark plug causes the combustion chamber temperature and pressure to rise rapidly to very high levels tending to cause the plug electrodes to wear very rapidly if the discharging at the spark plug is continued under such high temperature and pressure conditions, in accordance with the second embodiment the spark discharge at the spark plug is stopped in response to the detection of a flame by the flame detecting device and thus there is a great advantage that during the high combustion temperature and pressure period the spark discharge is prevented as far as possible and the wear of the spark plug electrodes is reduced considerably.

We claim:

1. An ignition system for an internal combustion engine having an output shaft rotated by the combustion of combustible mixture ignited by a spark, said ignition system comprising:

a power supply source;

an ignition coil having a primary and secondary windings, said primary winding being connected to said power supply source and said secondary winding generating a spark voltage when said primary winding is deenergized;

a spark plug connected to said secondary winding to be supplied with said spark voltage to thereby ignite the combustible mixture of said internal combustion engine;

first switching means connected in series with said primary winding for energizing and deenergizing said primary winding by said power supply source in response to the conduction and nonconduction thereof, respectively;

second switching means connected to said secondary winding in parallel relation with said spark plug for preventing said spark voltage from being supplied to said spark plug in response to the conduction thereof; and control means connected to said second switching means for switching said second switching means from the nonconduction to the conduction at a selected instant in time after the generating of said spark voltage.

2. An ignition system according to claim 1, wherein said control means comprises:

a position detector associated with said output shaft for generating an output signal in response to the arrival of said output shaft at a predetermined angular position; and a circuit connected to said position detector for switching said second switching means from the nonconduction to the conduction in response to said output signal of said position detector.

3. An ignition system according to claim 2, wherein said predetermined angular position is selected between 5 degrees before the top dead center position and 10 degrees after the top dead center position of said output shaft.

4. An ignition system according to claim 1, wherein said control means comprises:

an ion current detector mounted on said internal combustion engine for generating an output signal when the ion current flows in response to the initiation of combustion of the combustible mixture; and a circuit connected to said ion current detector for switching said second switching means from the nonconduction to the conduction in response to said output signal of said ion current detector.

* * * * *